United States Patent [19]

Turner

[11] 4,329,175

[45] May 11, 1982

[54] PRODUCTS MADE BY POWDER METALLURGY AND A METHOD THEREFORE

[75] Inventor: Neville G. Turner, Bolton, England

[73] Assignee: Rolls-Royce Limited, London, England

[21] Appl. No.: 100,788

[22] Filed: Dec. 5, 1979

Related U.S. Application Data

[63] Continuation of Ser. No. 888,361, Mar. 20, 1978, abandoned.

[30] Foreign Application Priority Data

Apr. 1, 1977 [GB] United Kingdom ..... 13803/77

[51] Int. Cl.[3] ..... B22F 3/00

[52] U.S. Cl. ..... 75/208 R; 75/226; 416/223 A; 416/223 R; 416/213 R

[58] Field of Search ..... 416/223 A, 223 R, 213 R; 75/208 R, 226

[56] References Cited

U.S. PATENT DOCUMENTS

| | | | |
|---|---|---|---|
| 3,283,377 | 11/1966 | Chandley | 416/223 A |
| 3,697,261 | 10/1972 | Jump et al. | 75/208 R |
| 3,940,268 | 2/1976 | Catlin | 75/208 R |
| 3,976,482 | 8/1976 | Larson | 75/214 |
| 4,063,939 | 12/1977 | Weaver et al. | 75/226 |
| 4,101,712 | 7/1978 | Bomford et al. | 416/223 R |

*Primary Examiner*—Brooks H. Hunt

*Attorney, Agent, or Firm*—Stevens, Davis, Miller & Mosher

[57] ABSTRACT

An article such as a gas turbine rotor blade or bladed rotor is made by consolidation of metal powders contained in a mould using the technique of hot isostatic pressing. Different properties are produced in different portions of the mould corresponding to those parts with either metal powders of different alloys or with metal powders made from one alloy but differently pretreated, e.g. by rolling, to impart mechanical strain into the powders.

7 Claims, 5 Drawing Figures

PRODUCTS MADE BY POWDER METALLURGY AND A METHOD THEREFORE

This is a continuation of application Ser. No. 888,361 filed Mar. 20, 1978 now abandoned.

The present invention relates to improvements in products formed by powder metallurgy and to a method therefor, and has particular reference to the use of the technique of hot isostatic pressing to consolidate metal powders into shaped components.

The technique of hot isostatic pressing is applicable to a range of metal alloys, including the so called nickel super alloys, which are extensively used in the construction of highly stressed parts for gas turbine engines that are additionally subjected to high operating temperatures.

By the technique the metal alloy is first formed into a powder having generally spherical particles of a predetermined size. The powder is subsequently introduced into a mould resembling the finished article and compacted, by use of vibration, to fill the mould evenly. Because of the interstices between the individual particles the density of the filled mould is at this stage approximately 70% of the density of the metal alloy. The mould, which is conventionally either of metal or glass, is evacuated before being sealed and placed in an autoclave for hot isostatic pressing. In the autoclave the mould is raised to a temperature of about 1,200° C. and a steady pressure in the range 12,000–14,000 pounds per square inch is applied to the mould for a period of several hours. During this time the mould progressively contracts under the pressure and the powder alloy is consolidated into an article having a density equal to the density of the alloy. The powder is then referred to as being fully consolidated or in the 100% dense condition.

The fully consolidated article is found to possess desirable properties such as homogeneity of structure and reasonable mechanical properties namely resistance to fatigue, and to creep, and moderately high tensile strength.

It is known that if the powder particles are subjected to a degree of mechanical deformation before consolidation, e.g. by passing the powders between a pair of rollers, then the deformation produced assists in refining the structure of the consolidated article. The use of such deformation can be utilized to adjust the mechanical properties of the consolidated article.

The technique of hot isostatic pressing is beneficially used for producing components such as turbine blades, rotor discs, and integrally bladed rotors for gas turbine engines.

In designing turbine blades and rotors due regard is paid to the environments in which each must operate.

Considering, for example, the turbine blade the aerofoil portion is normally called upon to operate at metal temperatures of up to 1,050° C. and the metal of which it is constructed should preferably be endowed with good resistance to creep and creep rupture, with good resistance to thermal fatigue associated with thermal gradients in the aerofoil and with moderately high tensile strength.

In contrast the blade root operates at metal temperatures of up to 750° C. and requires to have considerably higher tensile strength and is more prone to failure which is generally associated with mechanical fatigue. As a second example, in an integrally bladed turbine rotor the blades would operate at temperatures up to 1,050° C. and need the same properties as described above for individual turbine blades whilst the rotor hub will operate at temperatures up to 750° C. and must have good tensile strength in order to resist bursting.

Thus it will be seen that components exist for which, in order to optimize their lives or alternatively to allow them to be used in more hostile environments, it is desirable to provide one portion of the component with different properties from another.

The variation of properties in a component at different parts thereof has previously only been achievable by differential heat treatment applied to differing parts of the article for example to castings; by controlling the solidification of the article during casting, or by fabricating the article in parts and subsequently joining the parts together. Such methods, however, are either relatively limited in the extent of the differing properties that can be achieved in different portions of the component or introduce further problems such as the existence of a weld or other bond. The present invention seeks to provide a method of forming an article having differing properties in different portions thereof and which utilizes the advantages of the technique of hot isostatic pressing, to produce an article consolidated to the fully dense condition.

According to the present invention there is provided a method of forming an article by hot isostatic pressing, the method comprising the following steps:

(a) taking a mould suitable for receiving a metal powder for subsequent consolidation into an article;

(b) filling one portion of the mould with a metal powder to produce in the consolidated article certain desirable properties for that portion of the article corresponding to the said portion of the mould, said properties corresponding to the type and condition of the metal powder chosen;

(c) filling a second portion of the mould with further metal powder to produce in the portion of the consolidated article corresponding to the second portion of the mould desirable properties differing from those of the properties of the first said portion of the article, said properties corresponding to the type and condition of said further metal powder chosen; and (d) consolidating the article by the technique of hot isostatic pressing.

If necessary a subsequent heat treatment may be used to ensure adequate grain growth in the finished article. The heat treatment may immediately follow the hot isostatic pressing without first allowing the article to attain the ambient temperature.

According to one aspect of the method the further metal powder comprises a metal powder of a different metal to that of said first metal powder.

According to another aspect of the method at least one of said first metal powder or said further metal powder has been previously treated to develop in the portion of the consolidated article corresponding to the respective one of said first metal powder or further metal powder properties representative of said treatment.

According to a further aspect of the method, after filling the first portion of the mould with metal powder this portion is compacted prior to filling of the second portion with further metal powder or alternatively, according to a second aspect of the method the second portion may be also filled and then both portions compacted simultaneously.

In yet a further aspect of the method several different portions of the mould corresponding to several different portions of the article are filled with respective portions of metal powder selected to produce in the finished article differing properties in the different portions of the article.

The invention also comprises an article made by any of the above methods.

An embodiment of the inventions will now be described by way of example only and with reference to the accompanying drawings in which.

Figure 1:
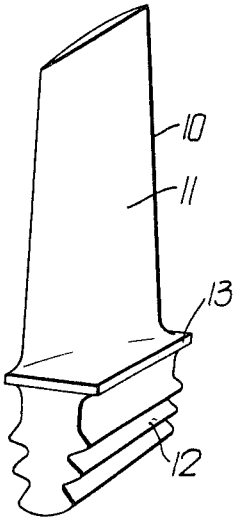
FIG. 1 illustrates a turbine rotor blade.

Referring now to FIG. 1 there will be seen a typical gas turbine rotor blade 10 having an aerofoil portion 11, and root portion 12 including a platform 13. For such a turbine rotor blade it is desirable that the aerofoil portion should have good resistance to creep and creep rupture, good resistance to fatigue induced by thermal gradients, and a moderately high tensile strength. In conventional wrought nickel alloy blade materials these properties are associated with a relatively coarse grain condition such as is typically defined by U.S. standard ASTM 0-1 grain size.

In contrast, for the root portion 12 of the turbine blade, the properties of high tensile strength and good resistance to mechanical fatigue are more important. These properties are associated in a wrought nickel alloy with a relatively fine grain structure such as is typically defined by the U.S. standard ASTM 4, or finer.

Figure 2:
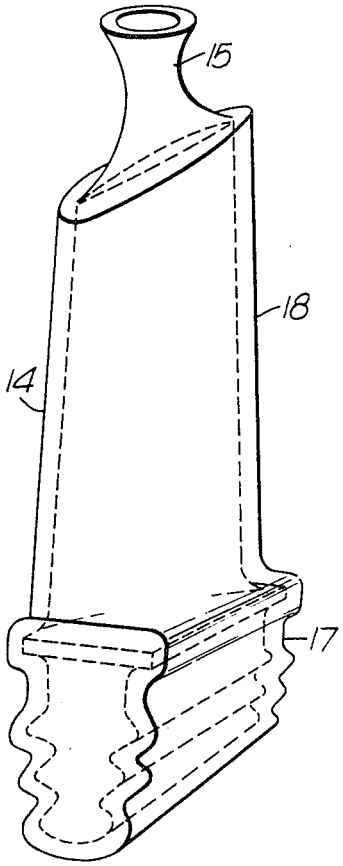
FIG. 2 illustrates a mould for producing the turbine rotor blade of FIG. 1.

Turning now to FIG. 2 there is shown a mould 14 for producing the turbine rotor blade of FIG. 1. The mould 14, which resembles the shape of the rotor blade 10, but is of larger size is of ceramic and is made in the same way as ceramic moulds for investment casting. This technique, well known in the art, is generally along the lines of the freeze casting process described in U.S. Pat. No. 2,811,760 to Clifford Shaw or other methods of producing conventional foundry investment shells. Alternatively, the mould is an injection moulded glass vessel or is fabricated in two halves from mild steel or other sheet metal pressings.

The mould is provided with a filling neck 15 through which the mould, is filled with metal powder and by means of which the mould is evacuated after filling and compaction.

In carrying out the process the portion 17 of the mould corresponding to the root portion 12 of the turbine blade is first filled through the neck 15 with nickel based alloy powder in the standard atomized form. This powder is then compacted by vibration until it reaches an even distribution at the 70% dense condition in the portion 17 of the mould. The portion 18 of the mould corresponding to the aerofoil portion of the turbine blade is then subsequently filled with nickel based alloy powder previously treated, as later explained, to produce deformation of the powder particles. The mould is then once more vibrated to pack also the metal powder in the aerofoil portion of the blade.

After filling and compaction, tube 15 is connected to a vacuum pump and air is withdrawn from the mould until a low pressure, typically 0.1 micron, prevails. The mould is then sealed in the filling neck 15 for example by cementing in a conical ceramic plug (not shown) or, in the case of a glass or steel mould by respectively either heating the glass and pinching it together at the filling neck, or pinching the steel pressing together and seam welding it. The mould is then removed to an autoclave for hot isostatic pressing.

The nickel based alloy powder is usually received from suppliers in the standard atomized form and has been made by gas atomizing molten metal in vacuo to generate predominantly spherical particles having a very fine cast structure and having diameters in the range up to 250λ i.e. up to 60 mesh in the British Standard fine mesh series. The standard atomized powder is mechanically treated by deforming it to produce a powder in which each spherical particle has had a permanent compressive strain in the range 0 to 8% imparted to it. This strain, the amount of which is critical, is achieved by passing the powder between pairs of steel rolls the size of roll gap having been preset to compress the spherical particles by the required amount, the spherical particles then assume the shape of oblate spheres.

Because the standard particles contain a range of powder particle diameters it needs to be sorted e.g. by sieving into batches of more closely controlled particle sizes, and each batch separately rolled with an appropriate roll gap setting to achieve the necessary compressive strain. During the hot isostatic pressing operation the strain in the mechanically treated powder particles, combined with the temperatures prevailing, results in critical grain growth of grains of the alloy which, either during consolidation or by subsequent heat treatment, results in a relatively large grain size tyically ASTM 0-1, according to the U.S. standard.

In the autoclave the mould 14 is subjected to a temperature in the range 930° C. to 1,280° C. and to external isostatic gas pressure in the range 7,000 to 30,000 psi and which acts over the external surface of the mould and ensures the metal powder is consolidated to 100% theoretical density.

Thus, when the mould 14 is hot isostatically pressed to consolidate the powder into a turbine blade the resulting grain size in the aerofoil portion 11 of the turbine blade corresponds to the desired relatively coarse grain condition and the grain size in the root portion corresponds to the desired relatively finer grain condition.

Figure 3:
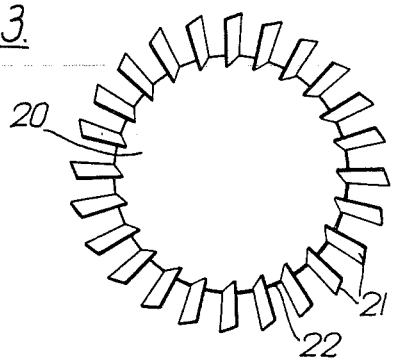
FIG. 3 illustrates a bladed turbine rotor.

Turning now to FIG. 3 there is shown an integrally bladed turbine rotor 20 in which a plurality of turbine blades 21 are formed integrally with the rim of a turbine rotor disc 22. For such a component it is desirable that the blades 21 have the relatively coarse grained condition of the aerofoil portion of the turbine blade of the previous embodiment and that the disc portion has the relatively finer grained structure of the root portion of the aforementioned turbine blade.

Figure 4:
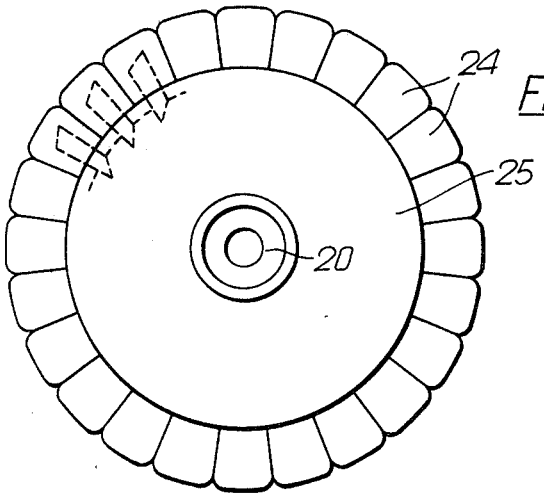
FIG. 4 illustrates a mould for producing the bladed rotor of FIG. 3 and, FIG. 5 illustrates a method of filling the mould of FIG. 4.
Figure 5:
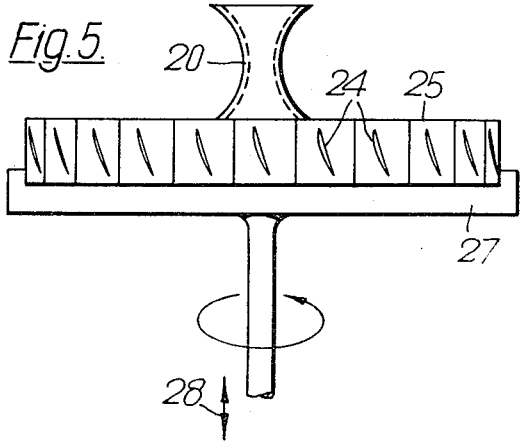

This is achieved by forming the mould of FIGS. 4, 5, in similar fashion to the mould of FIG. 2 i.e. it is produced either as a ceramic investment or as a glass mould or as a sheet metal container. The portions 24 of the mould corresponding to the turbine blades 2 are filled with mechanically treated nickel based alloy powder and the portion 25 of the mould corresponding to the disc portion 22 is filled with the standard atomized powder.

As the portions 24 are evenly distributed around the periphery of the mould they can no longer be simply filled under gravity so instead the mould is provided with a central filling neck 20 and is placed on a rotatable table 27 (FIG. 5). Rotation of the table is utilized to centrifuge the mechanically treated powder into the mould portions 24 prior to filling the mould portion 25 with the standard atomized powder. Vibration 28 applied to the table may be used to pack the powder into the mould portion 25. The mould is then sealed and evacuated in similar fashion to the mould for a turbine rotor blade before being removed to a machine for hot isostatic pressing.

Whilst in the foregoing each article, be it the turbine rotor blade or the bladed turbine rotor, has been made with each of its various portions containing material of the same chemical composition. It will be appreciated that, for example, especially in the case of a bladed turbine rotor, advantage may be gained by forming the blades with mechanically treated powder of say the alloy IN 792 (Regd. T.M.) and forming the disc with standard atomized powder of say either IN 100 or the alloy M.A.R. M-247 (both Regd. T.M's.). This would enable the turbine blades to enjoy good hot corrosion resistance and the disc to have relatively higher tensile and fatigue strength.

In a further modification it is herein proposed that the complication of sealing the ceramic mould is avoidable by placing the unsealed mould in a thin walled metal enclosure which is itself subsequently evacuated and sealed. The metal enclosure will simply collapse around the mould under the conditions prevailing in the autoclave.

It is of course permissible to replace the standard atomized powder utilized for the blade root portion with powder that has been mechanically treated in similar fashion to that used for the aerofoil portion except that in this instance a much higher degree of deformation would be required, typically a permanent compression amounting at least 40% and preferably 60% of the original particle diameter, in order to produce the desired grain structure in the finished article.

One advantage stemming from use of the above described techniques is that a certain amount of intermixing of the two powder types will occur at the interface between the hem. This intermixing will ensure that, in the finished article there will be a progressive change of properties rather than an abrupt transition. Use can be made of this by suitably blending different powders to promote this progressive change as spread over a larger distance.

It will be further appreciated that many other modifications may be made to the method and that the method may readily be applied to other articles and to alloys other than those based on nickel.

I claim:

1. A method of forming a turbine blade having a root portion and an aerofoil portion, said method comprising the steps of:

(a) taking a mold having a first portion corresponding to the root portion of the blade and a second portion corresponding to the aerofoil portion of the blade;

(b) introducing into the first portion of the mold a first nickel based alloy powder in a form which will subsequently produce a fine grain structure relative to the aerofoil portion, the particles of the first powder have been previously worked to impart strain energy to the particles to a degree suitable for producing finer grain structure in the root portion of the blade than in the aerofoil portion;

(c) introducing into the second portion of the mold a second nickel based alloy powder which has been worked to the critical amount of cold work so that critical grain growth results in the aerofoil portion of the powder to a degree suitable for subsequently producing a coarse grain structure in the aerofoil portion; and (d) compacting the powders in the mold by isostatically pressing the mold at a temperature at which a compacted unitary body is formed with coarse grains in the aerofoil portion and finer grains in the root portion.

2. A method according to claim 1 and comprising the further step of promoting a degree of intermixing of said first powder and said second powder at the interface between said first and second portions whereby to produce at the corresponding interface in the blade a progressive change between the respective properties associated with the two said portions.

3. A method according to claim 1 and comprising the step of filling both said portions of the mold and subsequently vibrating the mold to simultaneously compact the powders in both portions prior to consolidating the powder by the technique of hot isostatic pressing.

4. A method according to claim 1 and comprising the further step of vibrating the mold to compact the first powder in said first portion of the mold prior to admitting the second powder to the second portion of the mold and subsequently compacting also this second portion by vibration prior to consolidating the turbine blade by the technique of hot isostatic pressing.

5. A turbine blade made by the method of claim 1.

6. A method of forming a bladed turbine rotor assembly having a hub and blades extending radially therefrom, said method comprising the steps of:

(a) taking a mold having a first portion corresponding to the hub of the rotor assembly and a second portion corresponding to the blades of the rotor assembly;

(b) introducing into the first portion of the mold a metal powder comprising a nickel based alloy powder in atomized form, which powder has been previously worked to impart strain energy to a degree suitable for producing finer grain structure in the hub of the assembly than in the blades;

(c) introducing into the second portion of the mold a metal powder comprising a nickel based alloy powder, worked to the critical amount of cold work so that critical grain growth results in the blades of the rotor assembly, that has been treated to introduce mechanical strain in the particles of the powder suitable for subsequently producing a coarse grain structure in the blades; and (d) isostatically pressing the mold to compact the powders in the mold at a temperature at which coarse grains are retained in the blades and finer grains are retained in the hub of the rotor assembly.

7. A method of forming a bladed turbine rotor assembly in accordance with claim 6 and comprising the further step of rotating the mold during the filling thereof with one of the powders whereby to distribute the powder to the extremities of the mold.

* * * * *